United States Patent [19]

Woodward

[11] 4,163,961

[45] Aug. 7, 1979

[54] ROTARY JOINT

[75] Inventor: Oakley M. Woodward, Princeton, N.J.

[73] Assignee: RCA Corporation, New York, N.Y.

[21] Appl. No.: 886,103

[22] Filed: Mar. 13, 1978

[51] Int. Cl.[2] ..... H01P 1/06; H01P 1/16; H01P 5/12

[52] U.S. Cl. ..... 333/261; 333/21 A; 333/251

[58] Field of Search ..... 333/6–9, 333/98 TN, 98 R, 97 R, 27, 21 R, 21 A, 98 M, 31 R, 31 A; 343/757, 758, 759, 760, 761, 762

[56] References Cited

U.S. PATENT DOCUMENTS

| | | | |
|---|---|---|---|
| 2,523,348 | 9/1950 | White et al. | 333/6 |
| 2,782,384 | 2/1957 | Zalesky | 333/98 TN |

OTHER PUBLICATIONS

Wood–"Microwave Rotating Joints" (Part 2) Electron, Mar. 27, 1975, pp. 21, 23, 24.

*Primary Examiner*—Alfred E. Smith
*Assistant Examiner*—Marvin Nussbaum
*Attorney, Agent, or Firm*—H. Christoffersen; Joseph D. Lazar

[57] ABSTRACT

Input and output waveguides are each formed from an inner tubular conductor coaxially disposed within an outer tubular conductor. The proximal ends of the waveguides are coupled through relatively rotatable sleeves of a coupling assembly that maintains the waveguides coaxial with a central axis. The field strength of a wave at the distal end of the input waveguide defines two cycles of a sinusoid about the axis. The inner conductors each carry on their outer surface an equal number of evenly spaced ridges. The ridges in the input waveguide cause the field strength to be invariant at the proximal ends. The ridges in the output waveguide cause the field strength to define the two cycles of the sinusoid at the distal end of the output waveguide.

9 Claims, 5 Drawing Figures

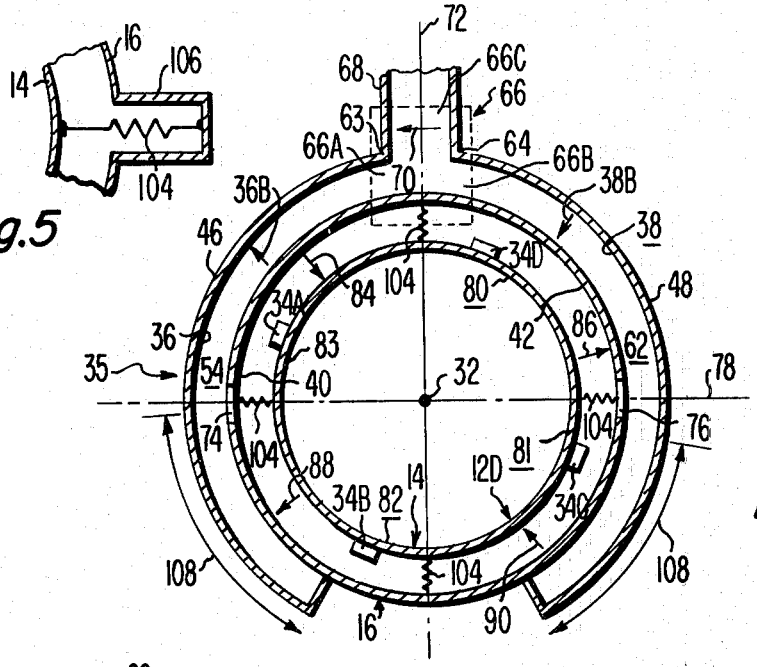
Fig.5
Fig.3
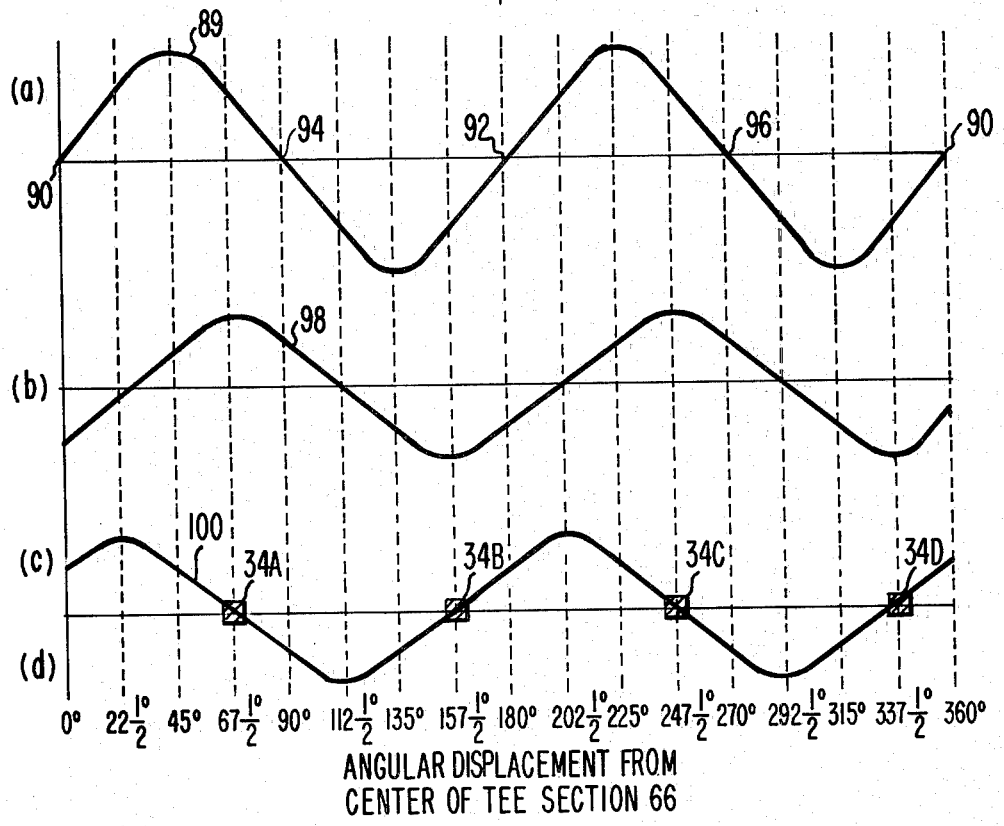
Fig.4

ROTARY JOINT

CROSS REFERENCE TO RELATED APPLICATION

Of interest is the following copending application: Ser. No. 730,333, filed on Oct. 7, 1976, and now U.S. Pat. No. 4,103,262 entitled, "Dual Channel Transmission of Microwave Power Through an Interface of Relative Rotation," based on an invention of the instant inventor.

BACKGROUND OF THE INVENTION

1. Field of the Invention

This invention relates to transmission of electrical signals and more particularly to transmission of signals at a microwave frequency through an interface comprised of members that are relatively rotatable.

2. Description of the Prior Art

In a space communication system, for example, it may be necessary to transmit electrical signals at a microwave frequency from a stationary power source, through a single channel of what is known as an interface of relative rotation, to a rotatable antenna. When the signal is transmitted through slidable contacts, such as brushes and slip rings, the slidable contacts generate noise signals and dissipate a substantial amount of power. For this reason, slidable contacts are not desirable as the interface of relative rotation.

Preferably, the interface of relative rotation includes a coupling assembly that has noncontacting, overlapping sleeves of a length equal to one quarter of a wavelength associated with the transmitted signal. The sleeves are connected to the lines to provide a noncontacting electrical coupling therebetween. The assembly includes bearings that maintain the lines in axial alignment with one line axially rotatable with respect to the other.

The coupling assembly of the type referred to hereinbefore is described in pages 100–114 of the book, "Microwave Transmission Circuit," edited by George L. Ragen and published as Volume 9 of the Massachusetts Institute of Technology Radiation Laboratory Series. The coupling assembly and the lines comprise what is known in the art as a rotary joint.

In constructing such a rotary joint, it is desirable to make the lines with as large a diameter as possible, thereby preventing either an over heating or a breakdown of the lines when the signal is transmitted at a high power level. However, when the diameter of the lines is too large, there may be undesired modes of transmission through the rotary joint, thereby causing a substantial power loss within the lines. Additionally, power transmitted through the rotary joint may be a function of a rotational position of one of the lines relative to the other. Therefore, in the prior art there is usually a well defined limit to the diameter of the coaxial transmission lines.

It is often desirable to transmit signals from two sources through two channels of the interface of relative rotation. When a rotary joint is constructed with two channels, it is complex and, additionally, has a size that is limited for reasons similar to those given above.

SUMMARY OF THE INVENTION

According to the present invention, input and output waveguides are each formed from an inner tubular conductor coaxially disposed within an outer tubular conductor, thereby forming waveguide cavities between the walls of the conductors. Input and output waveguide discontinuities are respectively carried within the cavities of the input and output waveguides. The proximal ends of the waveguides are coupled through relatively rotatable non-contacting, overlapping sleeves of a coupling assembly that maintains the conductors coaxial with a central axis. When the field strength of a wave at the distal end of the input waveguide is a substantially sinusoidal function of at least twice the angular position about the axis with respect to a datum, the input discontinuity cause the field strength at the proximal ends to be invariant with respect to the angular position. The output discontinuity causes the field strength at the distal end of the output waveguide to be the substantially sinusoidal function.

BRIEF DESCRIPTION OF THE DRAWING

FIG. 3 is a view of the embodiment of FIG. 1 taken along the line 3—3 of FIG. 2;

FIG. 4 is a graphic showing of waveshapes of electric fields established in the embodiment of FIG. 1; and FIG. 5 is a view of a stabilization resistor in the embodiment of FIG. 1.

DESCRIPTION OF THE PREFERRED EMBODIMENT

The present invention is predicated upon causing the strength of the electric field of a wave to be invariant with respect to angular position about the axis of a coupling assembly of the type described hereinbefore. Because the field strength is invariant, there is no change in the field when one of the quarter wave sleeves of the coupling assembly is axially rotated with respect to the other quarter wave sleeve thereof.

In an exemplary embodiment of the invention, a hollow rotary joint is comprised of transmission lines with a circumference in an approximate range of two to four wavelengths of electromagnetic energy associated with microwave power transmitted therethrough. In an alternative embodiment, the lines may have a larger circumference.

Since the rotary joint is hollow, another rotary joint, a waveguide or other network may be disposed therein. A small rotary joint used at X band, for example, may be disposed within a large rotary joint used at C band, whereby the invention may be used to provide a compact coupling to two ports of a rotatable antenna.

Figure 1:
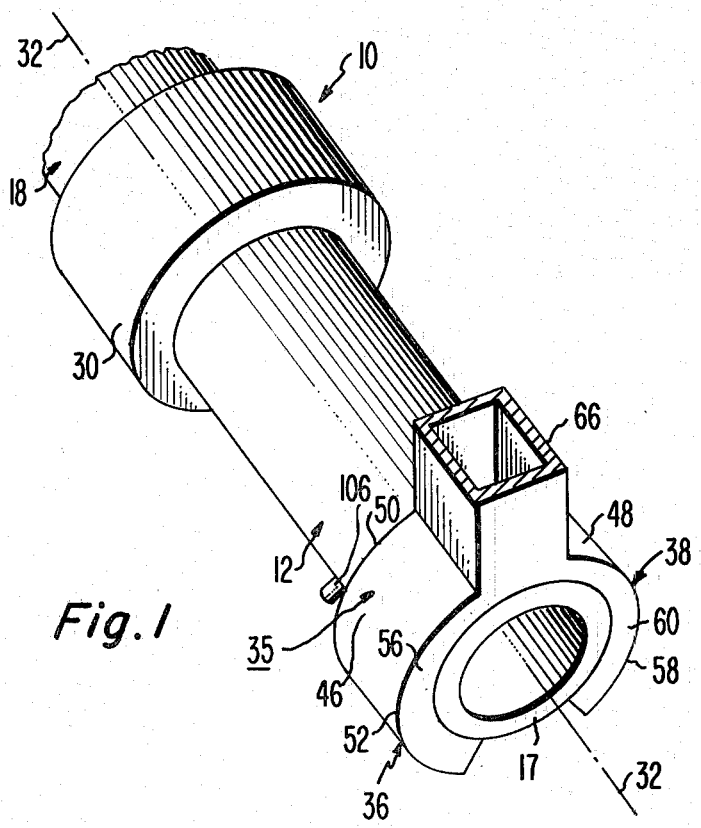
FIG. 1 is a perspective view, with parts broken away, of a preferred embodiment of the present invention.
Figure 2:
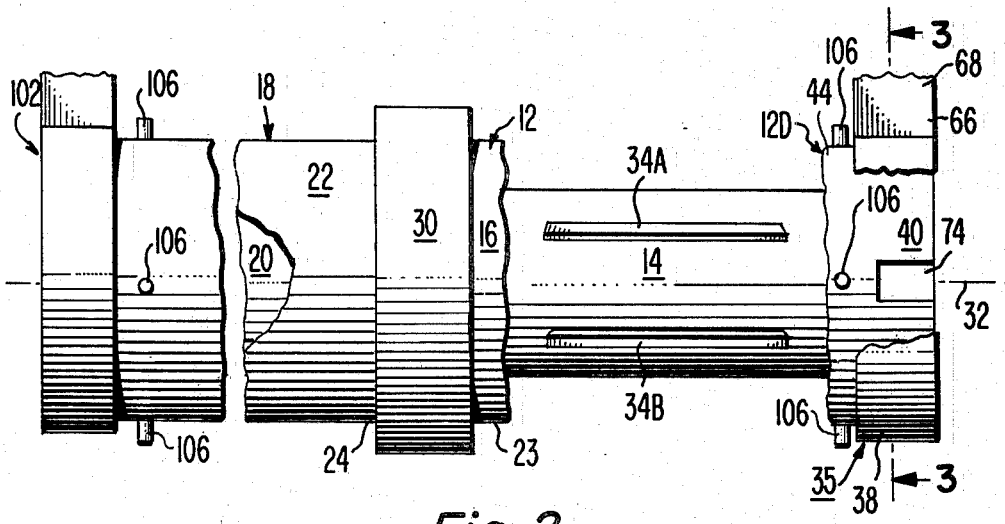
FIG. 2 is a side elevation, with parts broken away, of the embodiment of FIG. 1.

As shown in FIGS. 1–3, a rotary joint 10 includes an input waveguide 12 that is comprised of an inner tubular conductor 14 (FIG. 2) coaxially disposed within an outer tubular conductor 16. The distal ends of conductors 14 and 16 are connected together by an annular end wall 17 (FIG. 1). The cavity of waveguide 12 is between the exterior surface of conductor 14 and the interior surface of conductor 16. Preferably, conductors 14 and 16 have a distance therebetween less than one half of a wavelength of a wave that propagates through rotary joint 10.

Rotary joint 10 additionally includes an output waveguide 18 (FIG. 2) comprised of an inner tubular conductor 20 (similar to conductor 14) coaxially disposed within an outer tubular conductor 22 (similar to conductor 16). The distal ends of conductors 20 and 22 are connected by an end wall (not shown) similar to end wall 17. Similar to the cavity of waveguide 12, the cavity of waveguide 18 is between the exterior surface of conductor 20 and the interior surface of conductor 22.

The proximal end 23 of waveguide 12 and the proximal end 24 of waveguide 18 are coupled through a coupling assembly 30 of the type that has the noncontacting, overlapping sleeves. Accordingly, waveguides 12 and 18 are maintained in alignment with a central axis 32 and are axially rotatable relative to each other. It should be understood that coupling assembly 30 is substantially a hollow cylindrical structure. Therefore rotary joint 10 is hollow. Hence, a waveguide or other structure may be disposed within rotary joint 10.

The exterior surface of conductor 14 carries fixedly mounted ridges 34A–34D (FIGS. 2 and 3) that are equally spaced and parallel to axis 32. In an alternative embodiment, ridges may be carried on the interior surface of conductor 16. Conductor 20 carries ridges similar to ridges 34A–34D.

Ridges 34A–34D are what is known in the microwave art as a discontinuity in waveguide 12. According to the present invention, when a wave having a field strength that defines two cycles of a sinusoid about axis 32 is launched at the distal end 12D of waveguide 12, ridges 34A–34D cause a change in the phase velocity of a component of the wave. The change in the phase velocity causes the electric field strength of the wave at proximal ends 23 and 24 to be invariant with respect to angular displacement about axis 32.

Distal end 12D is connected to an input mode exciter 35 comprised of similar arcuate branch lines 36 and 38 (FIG. 1) that include an innermost wall 40 (FIGS. 2 and 3) and an innermost wall 42 (FIG. 3), respectively. Moreover, walls 40 and 42 are integral with the distal end 44 of conductor 16 and coaxial with axis 32. Branch lines 36 and 38 additionally have outermost walls 46 and 48, respectively, that are coaxial with axis 32. For reasons given hereinafter, walls 46 and 48 have an axial length in a preferred range of one half wavelength to one wavelength. Additionally, the distance between walls 40 and 46 and between walls 42 and 48 is less than one half wavelength.

Wall 46 has circular edges 50 and 52 (FIG. 1) that are respectively connected to walls 40 and 42 by end walls 54 (FIG. 3) and 56 (FIG. 1). Similarly, wall 48 has one circular edge 58 (FIG. 1) and another circular edge (not shown) respectively connected to walls 40 and 42 by end walls 60 and 62. It should be understood that walls 54, 56, 58, 60 and 62 are all perpendicular to axis 32.

From the explanation given hereinbefore, branch lines 36 and 38 have a rectangular cross-section and, therefore, are rectangular waveguides having a width equal to the axial lengths of walls 46 and 48, respectively. The heights of branch lines 36 and 38 equals the distances between walls 40 and 46 and between walls 42 and 48, respectively. Accordingly, the width of branch lines 36 and 38 is in the preferred range (one half wavelength to one wavelength).

Branch lines 36 and 38 have ends 63 and 64 that are integrally connected to a tee section 66 at respective aligned ports 66A and 66B thereof. Additionally, tee section 66 has a non-aligned port 66C integrally connected to a rectangular waveguide 68. A region within tee section 66, midway between ports 66A and 66B, is referred to hereinafter as a datum. Tee section 66 is disposed with the datum at arcuate displacements of approximately 67½ degrees and 22½ degrees, respectively, from ridges 34A and 34D.

A source (not shown) excites waveguide 68 to cause an excitation wave to propagate in the $TE_{10}$ mode to non-aligned port 66C. Moreover, within non-aligned port 66C the electric field of the excitation wave is represented by a field vector 70, which is perpendicular to axis 32. It should be understood that the direction of polarization of the excitation wave is represented by the direction of field vector 70.

The polarization of the excitation wave establishes a neutral plane 72 which includes the datum and axis 32. It should be appreciated that electric field strength is a null at distal end 12D within neutral plane 72. The polarization of the excitation wave additionally causes the impedances of branch lines 36 and 38 to be a series connected load on the source via tee section 66 and waveguide 68.

The excitation wave forms first and second branch waves that propagate through branch lines 36 and 38, respectively, about axis 32. When branch lines 36 and 38 have widths in the preferred range and heights of less than one half wavelength, the branch waves can only propagate in the $TE_{10}$ mode.

The electric fields of the first and second branch waves are respectively represented by branch field vectors 36B and 38B (FIG. 3), which are in opposite radial directions with respect to axis 32. Correspondingly, the first and second branch waves have polarizations that are in the opposite radial directions.

Branch lines 36 and 38 have similar slots 74 (FIG. 2) and 76 (FIG. 3) within walls 40 and 42, respectively, that have an angular displacement of 90 degrees about axis 32 from the center of tee section 66. Slots 74 and 76 are respective passageways from branch lines 36 and 38 to the cavity of waveguide 12, whereby the branch waves propagate to distal end 12D. As explained hereinafter, in response to the branch waves, an input wave propagates through waveguide 12 towards coupling assembly 30 (FIGS. 1 and 2).

The propagation of the branch waves cause a difference of potential across slot 74 and across slot 76. The differences of potential establish a neutral plane 78 that passes through the centers of slots 74 and 76. Additionally, neutral plane 78 includes axis 32. Electric field strength is a null at distal end 12D within neutral plane 78.

Neutral planes 72 and 78 divide waveguide 12 into quadrant sections 80–83. Within quadrant section 83, at distal end 12D, the first branch wave establishes a first quadrant electric field that has a direction toward axis 32. The first quadrant field is represented by a field vector 84.

Similarly, within quadrant section 80, at distal end 12D, the second branch wave establishes a second quadrant electric field that has a direction away from axis 32. The second quadrant field is represented by a field vector 86. It should be appreciated that vectors 84 and 86 are in opposite radial directions, whereby the first and second quadrant fields have opposite radial polarizations. The opposite radial polarizations cause electric field strength to be a null at distal end 12D at the boundary between quadrant sections 83 and 80 (neutral plane 72).

Similar to the establishing of the first and second quadrant fields, the first and second branch waves establish third and fourth quadrant fields represented by field vectors 88 and 90 within quadrant sections 81 and 82, respectively. Electric field strength is a null at distal end 12D at the boundary between quadrant sections 81 and 82 (neutral plane 72) for reasons similar to those given in connection with the null of the field strength at the boundary between quadrant section 80 and 83.

The quadrant fields are associated with four quadrant waves that propagate in the $TE_{10}$ mode through quadrant sections 80–83 towards coupling assembly 30. The quadrant waves combine to form what is hereinafter referred to as an input wave.

Quadrant sections 80–83 all have a mean arcuate length in the preferred range (one half wavelength to one wavelength) whereby the mean circumference of waveguide 12 is in the range of two to four wavelengths referred to hereinbefore.

As known to those skilled in the art, when the mean arcuate length of quadrant sections 80–83 is less than one half wavelength (the low end of the preferred range) the $TE_{10}$ mode of propagation of the quadrant fields cannot be established. When either the mean arcuate length is greater than one wavelength (the high end of the preferred range) or the distance between conductors 14 and 16 is greater than one half wavelength, the quadrant fields may propagate in spurious modes in addition to the $TE_{10}$ mode.

As shown in FIG. 4, illustration (a), electric field 89 of the input wave has a field strength that substantially defines two cycles of a sinusoid. Moreover, nulls 90 and 92 of field 89 are the field strength nulls in neutral plane 72 (FIG. 3) referred to hereinbefore. Correspondingly, nulls 94 and 96 are the field strength nulls in neutral plane 78.

Field 89 may be resolved into first and second component fields that each substantially define two cycles of a sinusoid. As shown in FIG. 4, illustration (b), a first component field 98 leads field 89 (illustration (a)) by one eighth of the length of a cycle (45 degrees). As shown in FIG. 4, illustration (c), a second component field 100 lags field 89 by one eighth of the length of a cycle (45 degrees). Accordingly, there is a separation of one fourth of a cycle between component fields 98 and 100, whereby the strengths of component fields 98 and 100 may be expressed as a sine and a cosine function, respectively, of angular position about axis 32. More particularly, strengths of component fields 98 and 100 at distal end 12D are in accordance with first and second field relationships which are given as:

$$E_{D98-}=A \sin (2\theta-45°) \quad (1)$$

$$E_{D100}=A \cos (2\theta-45°) \quad (2)$$

where $E_{D98}$ is the strength of component field 98 at distal end 12D;

$E_{D100}$ is the strength of component field 100 at distal end 12D;

A is the maximum strength of component fields 98 and 100; and $\theta$ is angular position about axis 32 measured counterclockwise from the datum.

As shown in FIG. 3, illustration (c), ridges 34A–34D are disposed at locations of the nulls of component field 100. Accordingly, ridges 34A–34D have no effect on the propagation of the component of the input wave associated with component field 100.

The nulls of component field 100 are at the locations of the maxima of component field 98. Therefore, ridges 34A–34D have a substantial effect on the propagation of component field 98. More particularly, ridges 34A–34D are selected to alter the phase velocity of the component of the input wave associated with component field 98, thereby causing component fields 98 and 100 to be in phase quadature with each other at proximal end 23 of waveguide 12 (FIG. 2). The strength of component field 98 at proximal end 23 is in accordance with third and fourth field relationships which are given as:

$$E_{P98}=A \sin (2\theta+90°+\alpha+45°) \quad (3)$$

$$=jA \sin (2\theta+\alpha-45°)$$

$$E_{100}=A \cos (2\theta+\alpha+45°) \quad (4)$$

where $E_{P98}$ is the strength of component field 98 at proximal end 23;

$90°+\alpha$ is a phase shift of component field 98 caused by propagation from distal end 12D to proximal end 23; and $\alpha$ is a phase shift of component field 100 caused by propagation from distal end 12D to proximal end 23.

Since component field 100 is unchanged by ridges 34A–34D, the field strength at proximal end 23 is in accordance with a fifth field relationship which combines the second field relationship (2) and the third field relationship (3). The fifth field relationship is given as:

$$E_{TP}=A \cos (2\theta+\alpha-45°)+jA \sin (2\theta\alpha-45°) \quad (5)$$

$$=|A| \underline{|2\theta+\alpha}$$

where $E_{TP}$ is the field strength of the input wave at proximal end 23.

Therefore, the field strength at proximal end 23 is independent of angular position about axis 32, whereby, the coupling of the input wave to proximal end 24 via coupling assembly 30 is substantially independent of rotation of waveguide 12 relative to waveguide 18.

It should be understood that waveguides 12 and 18 and mode exciter 35 are linear bilateral networks. Additionally, the distal end of waveguide 18 is connected to an output mode exciter 102 similar to mode exciter 35. Therefore, when the input wave propagates through coupling assembly 30 and mode exciter 102 via waveguide 18, a wave, similar to the excitation wave (at non-aligned port 66C) propagates through a non-aligned port of a tee section of mode exciter 102.

As known to those skilled in the art, when the input wave is transmitted through waveguide 12 towards coupling assembly 30, there may be an undesired reflected wave that is reflected from coupling assembly 30 towards mode exciter 35. Moreover, the maxima of the electric field of the undesired wave is at the nulls of field 89 at distal end 12D. The undesired wave is absorbed by stabilization resistors 104 (FIG. 3) mounted within distal end 12D at the locations of the nulls of field 89. As shown in FIG. 5, resistors 104 are connected from the exterior surface of conductor 14 to the interior surface of cylindrical resistance mounting stubs 106 that are integral with conductor 16.

In the construction of mode exciter 35 it is desirable that branch lines 36 and 38 have a length 108 from an angular location of slots 74 and 76 to provide reactances that minimize reflections of the branch waves towards tee section 66.

In an alternative embodiment there may be more than two slots that connect branch lines 36 and 38 to waveguide 12, thereby providing an input wave of more than two cycles. When the input wave has more than two cycles the mean circumference of waveguide 12 may be increased to provide for the $TE_{10}$ mode of propagation of half cycle portions of the input wave.

What is claimed is:

1. A rotary joint wherein a coupling assembly has non-contacting overlapping sleeves that are electrically coupled to each other at microwave frequencies and are relatively rotatable about an axis, comprising:

first and second outer tubular conductors;

first and second inner tubular conductors coaxially disposed within said first and second outer conductors, respectively, thereby forming input and output waveguides having respective cavities between said first and second conductors, the proximal ends of said waveguides being connected to said sleeves to provide a non-contacting electrical coupling of said waveguides through said sleeves;

mode exciter means for generating a wave at the distal end of said input waveguide in response to an input excitation signal, the electric field of said wave having a field strength that is a sinusoidal function of at least twice the angular displacement about said axis from a datum;

discontinuity means for causing said field strength to be substantially uniform at said proximal ends;

means for causing said field strength to substantially be said function of said angular displacement at the distal end of said output waveguide; and means for providing an output signal in response to said wave at the distal end of said output waveguide.

2. The rotary joint of claim 1 wherein a first discontinuity means comprises a group of ridges carried within the cavity of said input waveguide, said ridges being parallel to said axis with equal spacing therebetween.

3. The rotary joint of claim 2 wherein said ridges are fixedly mounted on the exterior surface of said first inner conductor.

4. The rotary joint of claim 3 wherein each of said ridges is fixedly mounted at a location of a null of the field strength of one of two components of said field where the strengths of said two components may be respectively represented as a sine and cosine function of at least twice said angular displacement about said axis from said datum, said components having substantially equal amplitudes.

5. The rotary joint of claim 1 wherein said mode exciter means comprises:

a tee section having first and second aligned ports and a non-aligned port;

a first arcuate branch line waveguide having a rectangular cross-section, an inner wall of said first branch line being formed by the distal end of said first outer conductor wherein a first slot forms a passageway between said first branch line and said input waveguide, one end of said first branch line being connected to said first aligned port;

a second arcuate branch line waveguide having a rectangular cross-section, an inner wall of said second branch line being formed by the distal end of said first outer conductor wherein a second slot forms a passageway between said second branch line and said input waveguide, one end of said second branch line being connected to said second aligned port, an input wave being provided in response to said input excitation being applied to said non-aligned port to cause first, second and third nulls of said field strength in the center of said tee section between said aligned ports, the center of said first slot and the center of said second slot, respectively.

6. The rotary joint of claim 5 wherein said field strength is a sinusoidal function of twice said angular displacement and a first discontinuity means comprises four ridges carried within the cavity of said first waveguide with equal spacing therebetween at locations of nulls of the field strength of one of two orthogonal components of said field that have equal amplitude, said slots having an angular displacement of 90° from the center of said tee section.

7. The rotary joint of claim 6 wherein the other ends of said branch lines include an end wall, and the respective lengths of said first and second branch lines from end walls thereof to said first and second slots is selected to substantially provide an impedance match of said branch lines to said non-aligned port.

8. The rotary joint of claim 6 wherein said waveguides have a mean circumference in a range of from two to four wavelengths associated with said excitation signal.

9. The rotary joint of claim 5 wherein said branch lines have a width in a range of one half to one wavelength associated with said excitation signal.

* * * * *